US005868446A

United States Patent [19]

Rossmo

[11] Patent Number: 5,868,446

[45] Date of Patent: Feb. 9, 1999

[54] GATE LATCH

[75] Inventor: William Rossmo, Saskatoon, Canada

[73] Assignee: New Line Products Inc., Saskatoon, Canada

[21] Appl. No.: 842,365

[22] Filed: Apr. 24, 1997

Related U.S. Application Data

[62] Division of Ser. No. 545,796, filed as PCT/CA94/00239 May 10, 1994, Pat. No. 5,720,082.

[30] Foreign Application Priority Data

May 11, 1993 [CA] Canada ..... 2095989

[51] Int. Cl.[6] ..... E05B 15/02

[52] U.S. Cl. ..... 292/341.17; 292/DIG. 55; 292/122; 292/341.18

[58] Field of Search ..... 292/341.17, 341.19, 292/341.18, 341.13, DIG. 55, 122, 121, 125, 219, 224

[56] References Cited

U.S. PATENT DOCUMENTS

| | | | |
|---|---|---|---|
| 126,191 | 4/1872 | Dickey | 292/341.19 |
| 633,008 | 9/1899 | Jeffers | 292/341.17 |
| 1,351,222 | 8/1920 | Tower | 292/341.18 |
| 2,028,954 | 1/1936 | Roedding | 292/122 |
| 3,266,831 | 8/1966 | Banse | 292/341.17 |
| 4,305,611 | 12/1981 | Robins . | |
| 5,358,292 | 10/1994 | Van Wiebe et al. | 292/125 |

FOREIGN PATENT DOCUMENTS

| | | | |
|---|---|---|---|
| 1756519 | 8/1992 | U.S.S.R. | 292/341.17 |
| 467207 | 6/1937 | United Kingdom | 292/122 |
| 659498 | 10/1951 | United Kingdom | 292/341.17 |
| 2275500 | 8/1994 | United Kingdom | 292/341.17 |

*Primary Examiner*—Darnell M. Boucher
*Attorney, Agent, or Firm*—Murray E. Thrift; Adrian D. Battison

[57] ABSTRACT

An adjustable gate latch has a striker bar and a latch component including a base with a track. The latch assembly slides along the track when engaged by a striker that is out of line with the latch member. This automatically compensates for relative movement between the gate and the associated gate posts.

4 Claims, 2 Drawing Sheets

GATE LATCH

CROSS REFERENCE TO RELATED APPLICATIONS

This application is a division of U.S. application Ser. No. 08/545,796 filed Nov. 9, 1995 now U.S. Pat. No. 5,720,082, and filed as PCT application PCT/CA94/00239 on May 10, 1994.

FIELD OF THE INVENTION

The present invention relates to a self adjusting gate latch.

BACKGROUND

Conventional gate and door latches are generally of good design and adequate for their intended purpose until the gate or door panel and the associated post or frame become misaligned, for example through ground movements or building settling. Such movements can occur seasonally. The result is misaligned panels that cannot be closed properly. In the case of a gate, damaged, broken or bent latch components may result.

The present invention is intended to ameliorate this problem.

SUMMARY

According to the present invention there is provided a latch for connecting a swinging panel to an adjacent stationary component, said latch comprising:

a striker bar mountable on the panel;

a base member mountable on the stationary component and including a track in the base member, a latch assembly including:

a track follower engaged in the track for movement therealong, a receiver mounted on the track follower and having a flared throat for receiving the striker, and a latching member mounted moveably on the latch assembly for capturing the striker in the receiver throat; and resilient means for biasing the latch assembly to a neutral position along the track, such that a misaligned striker, on engaging the receiver throat will cam the receiver throat to a position in which the striker will seat in the receiver throat and be captured by the latching member.

The latch is thus self adjusting in that the striker will cam the receiver to a position where the striker may be fully seated in the receiver throat and captured by the latching member.

BRIEF DESCRIPTION OF THE DRAWINGS

In the accompanying drawings, which illustrate exemplary embodiments of the present invention.

DETAILED DESCRIPTION

Figure 1:
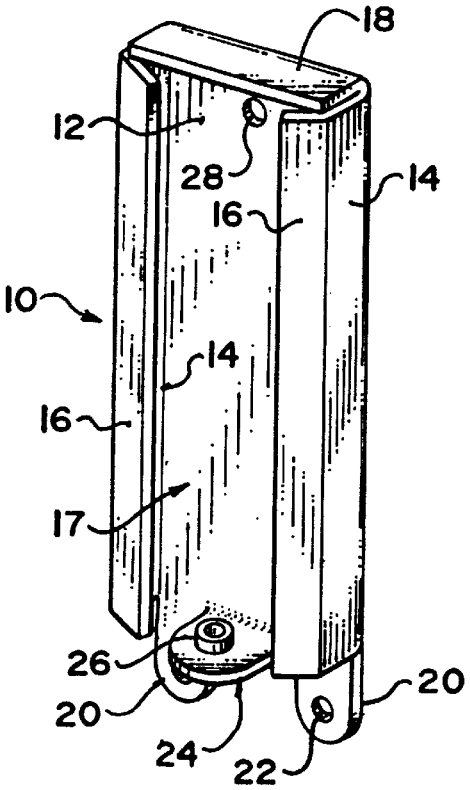
FIG. 1 is an isometric view of a latch base member.
Figure 3:
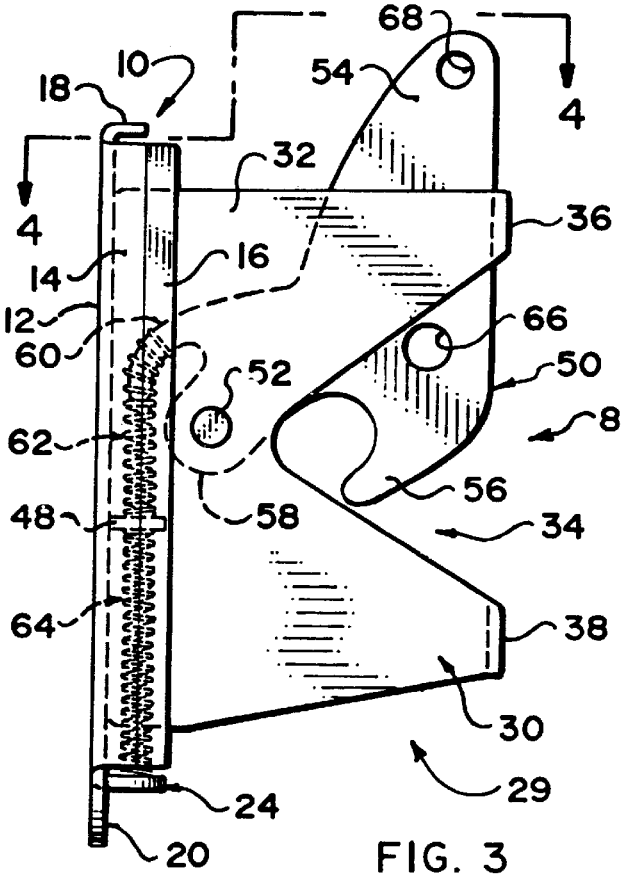
FIG.3 is a side view of a latch assembly.
Figure 4:
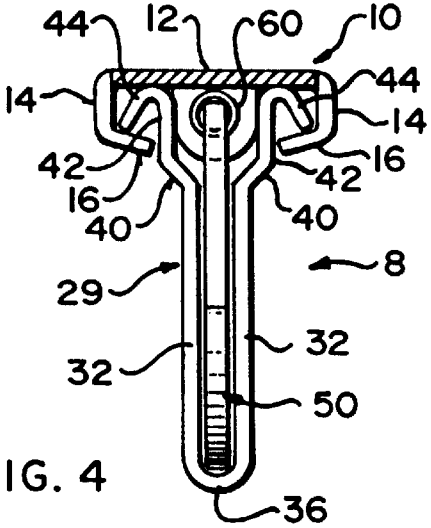
FIG. 4 is a view along line 4—4 of FIG. 3.

Referring to the accompanying drawings, there is illustrated in FIGS. 3 and 4, a self-adjusting gate latch 8. This includes a base 10 illustrated most particularly in FIG. 1.

The base includes a back plate 12 and two, spaced apart side flanges 14 projecting forwardly from the side edges of the back plate. Two lips 16 extend along the front edges of the flanges 14 and slope outwards towards one another to overlie the front of the back plate. The back plate 12, the flanges 14 and the lips 16 thus provide a track 17 extending from end to end of the base plate.

The top end of the track 17 is closed by an end flange 18. At the bottom edge, the base plate 12 has two mounting lugs 20, with screw holes 22. A third lug 24 projects to the front and carries a boss 26 on its top face.

Figure 2:
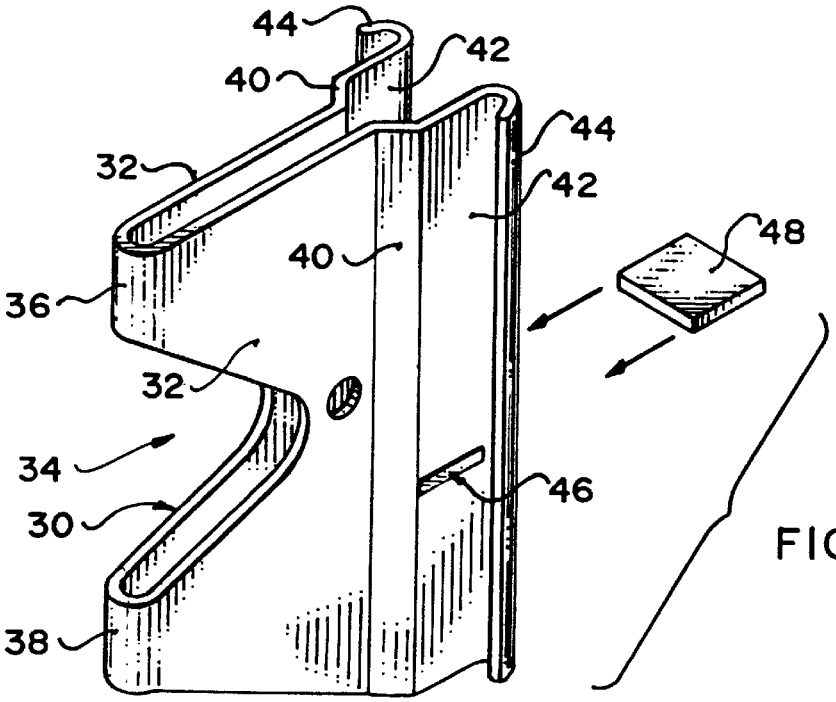
FIG. 2 is an isometric view of a latch receiver.

Another mounting screw hole 28 is located at the top of the base plate. A latch assembly 29 is illustrated in FIGS. 3 and 4. The latch assembly includes a receiver 30 (FIG. 2) with parallel side plates 32 configured to provide an outwardly flaring throat 34. The side plates are joined by two front webs 36 and 38. At the back of each side plate, is an offset 40 leading to an edge flange 42. The back edge of each flange 42 curves outwardly and to the front as a curved lip 44. These lips engage between the lips 16 and base plate 12 so that the receiver 30 will slide in the track 17 of the base. The flanges 42 have aligned slots 46 that engage the side edges of a spring support plate 48.

The receiver carries a latching member 50 in the form of a lever mounted on the receiver, between its side plates, by a cross pin 52. The latching member has an upper arm 54 projecting outwardly and upwardly above the receiver throat 34, and a tongue 56 projecting downwardly from the upper arm across the throat. A rear arm 58 extends to the back of the receiver throat for connection to the cross pin 52. A further spring retainer arm 60 projects to the rear and down from above the cross pin 52 to engage in the upper end of a coil spring 62. The lower end of the spring is seated on the plate 48. The spring biases the latching member to the latching position illustrated in FIG. 3. A second spring 64 extends between lug 24, where it engages boss 26, to plate 48, thus supporting the latch assembly in a neutral position, partway along the track 17.

The latching member 50 has a lock hole 66 for locking the latch with a padlock. A hole 68 in the upper arm 54 is used for attaching a rope or the like for opening the latch from another location, for example on the outside of a gate.

Figure 5:
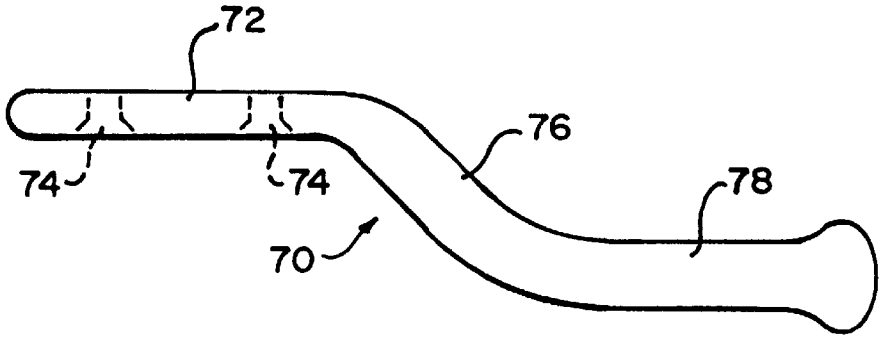
FIG. 5 is a top view of a striker bar.

A striker bar 70 for the latch is illustrated in FIG. 5. This includes a mounting end 72 with two holes 74 for mounting screws, an offset centre section 76 and a straight striker end 78 that engages in the receiver throat 34 and cams the tongue 56 of the latching member upwardly so that the striker bar may engage fully in the throat. The latching member tongue drops outside of the striker bar to capture it in the receiver throat.

In use, the latch assembly is assembled into the base and is supported in a neutral position half-way along the track 17. The base is mounted on the gate post in most instances, with the striker bar being mounted on the adjacent gate to engage centrally in the receiver throat when the gate is closed. In the event of any misalignment of the striker and the latch, the striker bar will engage the top or bottom side of the flared receiver throat and will cam the latching member either up or down in the track 17 until the striker bar seats fully in the throat and the latching member 50 falls into place behind it.

While one particular embodiment of the present invention has been described in the foregoing, it is to be understood that other embodiments are possible within the scope of the invention. The invention is to be considered limited solely by the scope of the appended claims.

I claim:

1. A latch for connecting a swinging panel to an adjacent stationary component, said latch comprising:

a striker bar mountable on the panel;

a base member mountable on the stationary component and including a track in the base member, a latch assembly including:

a track follower engaged in the track for free movement therealong, a receiver mounted on the track follower for movement along the track with the track follower, the receiver having a flared throat for receiving the striker, and a latching member mounted moveably on the receiver for capturing the striker in the receiver throat; and resilient means engaged with the base member and the latch assembly for biasing the latch assembly to a neutral position along the track, such that a misaligned striker, on engaging the receiver throat will cam the receiver throat to a position in which the striker will seat in the receiver throat and be captured by the latching member.

2. A latch according to claim 1, wherein the latching member is pivotally mounted on the receiver and has a tongue that projects across the receiver throat in a latching position to capture the striker in the receiver throat.

3. A latch according to claim 2, including a latch spring engaged with the receiver and the latching member for biasing the latching member to the latching position.

4. A latch according to claim 1 wherein the resilient means comprise opposed spring seats on the latch assembly and the base member, and a spring extending between the spring seats to bias the seats away from one another.

* * * * *